United States Patent [19]

Iizuka

[11] Patent Number: 4,984,922

[45] Date of Patent: Jan. 15, 1991

[54] LIQUID CONTAINER

[75] Inventor: Shigeo Iizuka, Funabashi, Japan

[73] Assignee: Yoshino Kogyosho Co., Ltd., Tokyo, Japan

[21] Appl. No.: 400,780

[22] Filed: Aug. 30, 1989

[30] Foreign Application Priority Data

Sep. 2, 1988 [JP] Japan ..... 63-115832

[51] Int. Cl.[5] ..... A46B 11/00; A45D 34/00

[52] U.S. Cl. ..... 401/277; 401/141; 401/176; 401/205; 401/278

[58] Field of Search ..... 401/273, 275, 278, 171, 401/176, 141, 116, 205, 277

[56] References Cited

U.S. PATENT DOCUMENTS

| | | | |
|---|---|---|---|
| 519,223 | 5/1894 | Bailey | 401/277 |
| 1,138,772 | 5/1915 | Matthews | 401/273 |
| 1,207,121 | 12/1916 | Zeidler . | |
| 1,348,681 | 8/1920 | Wright | 401/277 |
| 1,557,357 | 10/1925 | Gornell | 401/116 |
| 2,293,211 | 8/1942 | Mureau . | |
| 2,623,231 | 12/1952 | Gutenstein | 401/116 |
| 3,140,695 | 7/1964 | Fehling et al. . | |
| 3,167,806 | 2/1965 | Hogan . | |
| 3,181,539 | 5/1965 | Aston . | |
| 3,351,074 | 11/1967 | Aston . | |
| 3,359,992 | 12/1967 | Cishek et al. . | |
| 3,468,612 | 9/1969 | Aston . | |
| 4,033,700 | 7/1977 | Spatz . | |
| 4,309,119 | 1/1982 | Wittersheim . | |
| 4,405,249 | 9/1983 | Scales . | |
| 4,433,799 | 2/1984 | Corsette . | |
| 4,655,690 | 4/1987 | Boedecker et al. . | |
| 4,852,772 | 8/1989 | Ennis, III . | |

FOREIGN PATENT DOCUMENTS

| | | | |
|---|---|---|---|
| 165657 | 1/1954 | Australia . | |
| 62059/65 | 2/1967 | Australia . | |
| 440628 | 10/1973 | Australia . | |
| 0123518 | 10/1984 | European Pat. Off. . | |
| 199597 | 10/1986 | European Pat. Off. | 401/278 |
| 2630569 | 1/1978 | Fed. Rep. of Germany . | |
| 959036 | 3/1950 | France . | |
| 2551636 | 3/1985 | France . | |
| 552673 | 12/1956 | Italy . | |
| 62-86111 | 6/1987 | Japan . | |
| 63-52511 | 4/1988 | Japan . | |
| 136990 | 8/1952 | Sweden . | |
| 688891 | 3/1953 | United Kingdom . | |
| 1562817 | 3/1980 | United Kingdom . | |
| 2150424 | 7/1985 | United Kingdom . | |

*Primary Examiner*—Steven A. Bratlie
*Attorney, Agent, or Firm*—Oliff & Berridge

[57] ABSTRACT

The present invention relates to a toilet implement in which a shaft is rotated with respect to a piston member provided between the shaft and a liquid supply means whereby a cylinder is moved up and down to supply a liquid from a container body within a lower portion of the shaft into the liquid supply means. A leakage of liquid caused by the inadvertent advancement of a bottom of the container body which has been a disadvantage encountered in conventional toilet implements can be prevented.

6 Claims, 2 Drawing Sheets

LIQUID CONTAINER

FIELD OF THE INVENTION

The present invention relates to a toilet implement in which a barrel has a container body therein.

BACKGROUND OF THE INVENTION

As a conventional toilet implement, a toilet implement has been known, for example, from Japanese Utility Model Laid-open No. 63-52511. The conventional toilet implement of this kind is designed so that a pumping mechanism is provided between a tip provided at the extreme end of a shaft and a container body fitted into a lower portion of the shaft. The and the pump is actuated by pressing of a bottom of the container body from the lower end of the shaft to cause a liquid within the container body to flow into the tip.

In the conventional toilet implement of this kind, the bottom of the container body is exposed to the lower end of the shaft, and the liquid within the container body is moved into the tip by pushing the bottom of the container body relative to the shaft toward the tip. This pushing is naturally accomplished, and therefore, leakage of liquid from the tip may occur.

SUMMARY OF THE INVENTION

It is a main object of the present invention to provide a toilet implement which prevents such leakage of liquid as described above. A shaft is rotated relative to a piston member provided between the shaft and the liquid supply means whereby the liquid within the container body in the lower portion of the shaft can be supplied into the liquid supply means.

According to an embodiment according to the present invention, there is provided a toilet implement comprising a container body 1 having a bottom plate 3 fitted into a lower portion of a body portion 2, said bottom plate 3 capable of vertically moving in water-tight contact with an inner peripheral surface of said body portion; a cylinder 5 with a suction valve 6 standing upright with a lower portion of the cylinder 5 mounted in a mouth portion 4 of the container body 1; a member 10 with a piston, said member 10 having a cylindrical piston 11 fitted into said cylinder 5 at a lower end of the member 10, said member 10 having a discharge valve 13 in a first cylindrical portion 12 standing upright above the cylinder, said member 10 having an outer cylindrical portion 14 suspended from an upper portion of said first cylindrical portion 12; a liquid supply means 18 mounted on an upper end of said first cylindrical portion 12; and a shaft 22 having said cylinder 5 and said container body 1 vertically movably inserted therein and said shaft 22 having its upper end portion rotatably fitted in said outer cylindrical portion 14; the implement being designed so that a sine-wave like cam groove 8 peripherally extending over the whole periphery is provided in either an outer surface of said cylinder 5 or an inner surface of said shaft 22 while a projection 21 engaged in the cam groove 8 is provided on the other; and a longitudinal groove **10*a* is provided in either an inner surface of said cylinder 5 or an outer surface of said first cylindrical portion 12 of the member 10 with a piston while a longitudinal strip 9 vertically movably engaged in said groove 10*a*** is provided on the other.

In the toilet implement according to the present invention, when the shaft 22 is rotated with respect to the outer cylindrical portion 14 of the member 10, the cylinder 5 is vertically moved with respect to the cylindrical piston 11, because the projection 21 projected from the inner surface of the shaft 22 is engaged in the sine-wave like cam groove 8 peripherally provided over the whole periphery of the upper surface of the cylinder 5 and moved along the cam groove 8, and because the longitudinal projection 9 provided on the upper inner surface of the cylinder 5 can be vertically moved within the longitudinal groove **10*a* provided on the outer surface of the first cylindrical portion 12 of the member 10**.

Accordingly, the liquid within the container body 1 is moved into the cylinder via the suction valve 6, and the liquid in the cylinder is supplied into the liquid supply means via the discharge valve 13. The negative pressure resulting from the reduction in liquid within the container body is overcome by the upward movement of the bottom plate 3.

BRIEF DESCRIPTION OF THE DRAWINGS

The drawings show an embodiment of a toilet implement according to the present invention.

DESCRIPTION OF THE PREFERRED EMBODIMENT

Figure 1:
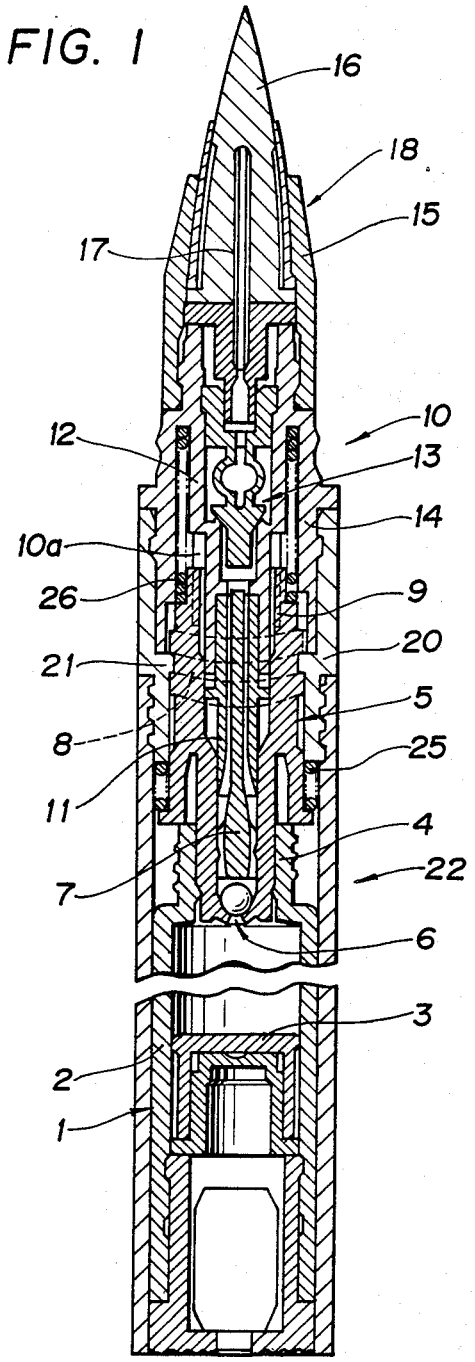
FIG. 1 is a longitudinal sectional view of a toilet implement according to the present invention.
Figure 2:
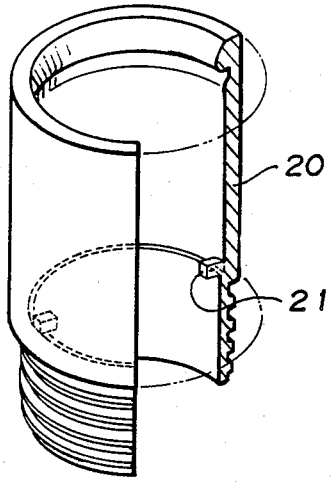
FIG. 2 is a perspective view showing a part of the shaft of the toilet implement with said part cutaway.

Reference numeral 1 designates a container body. A bottom plate 3 capable of being upwardly moved in water-tight contact with the inner wall surface of a body portion 2 is fitted in the lower portion of said body portion 2.

A cylinder 5 is stood upright with a lower portion thereof mounted within a mouth portion 4 of the container body 1, and a suction valve 6 is provided on the bottom of the cylinder 5. A guide rod 7 for a cylindrical piston may be stood upright as shown in the figure within the cylinder 5. A sine wave-like cam groove 8 peripherally extending over the whole periphery is peripherally provided in the upper outer surface of the cylinder 5, and a longitudinal strip 9 is provided on the upper inner surface of the cylinder.

A cylindrical piston 11 of a member 10 with a piston is fitted in the cylinder 5.

The cylindrical piston 11 is formed at the lower end of a first cylindrical portion 12, said first cylindrical portion being stood upright at an upper portion of the cylinder 5, and a discharge valve 13 is provided therein. A longitudinal groove **10*a* with the longitudinal strip 9 of the cylinder 5 vertically movably fitted therein is provided in the outer surface of the first cylindrical portion 12, and an outer cylindrical portion 14 is suspended from the upper part of the first cylindrical portion 12**.

A liquid supply means 18 composed of a member 15 with the tip 16 and a pipe 17 in the illustrated embodiment is mounted on the upper end of the first cylindrical portion 12. An upper half portion of the pipe 17 is grasped by a number of brushes which form the tip 16 in the lower half portion of a center line of the tip 16, the pipe 17 being communicated with the discharge valve 13.

An upper end portion of a shaft 22 with the cylinder 5 and the container body 1 vertically movably inserted therein comprises a second cylindrical section 20, and is rotatably fitted on the outer surface of the lower half portion of the outer cylindrical portion 14 of the member 10 with a piston. A projection 21 slidably fitted in the cam groove 8 of the cylinder 5 is provided on the inner surface of the second cylindrical portion 20 of the shaft 22.

A shaft 22 is composed of two cylindrical bodies and includes the second cylindrical portion 20. The shaft 22 may be formed such that two cylindrical bodies are threadedly joined as shown in FIG. 1, by which the toilet implement can be easily disassembled and assembled.

Reference numerals 25 and 26 designate coil springs, respectively, for preventing a play of the cylinder 5 relative to the cylindrical piston 11.

In the present invention, with the aforementioned arrangement, the shaft 22 is rotated with respect to the outer cylindrical portion 14 of the member 10 with a piston whereby the liquid in the container body can be supplied into the liquid supply means. Thereby, unlike the above-described conventional example, the inadvertent supply of liquid can be prevented, and accordingly, liquid dripping from the tip and the like can be eliminated.

What is claimed is:

1. A toilet implement comprising:

a container body having a bottom plate fitted into a lower portion of a body portion, said bottom plate capable of vertically moving in water-tight contact with an inner peripheral surface of said body portion;

a cylinder with a suction valve, a lower portion of the cylinder mounted in a mouth portion of the container body;

a member with a piston, said member having a cylindrical piston fitted into said cylinder at a lower end of the member, said member having a discharge valve located in a first cylindrical portion of the cylinder, said member having an outer cylindrical portion suspended from an upper portion of said first cylindrical portion;

a liquid supply means mounted on an upper end of said first cylindrical portion; and a shaft having said cylinder and said container body vertically movably inserted therein, said shaft having its upper end portion rotatably fitted in said outer cylindrical portion;

a sine-wave like cam groove peripheral extending over the periphery one of an outer surface of said cylinder and an inner surface of said shaft while a projection engaged in the cam groove is provided on the other; and a longitudinal groove in one of an inner surface of said cylinder and an outer surface of said first cylindrical portion of the member with a piston while a longitudinal strip vertically movably engaged in said groove is provided on the other.

2. The toilet implement according to claim 1, wherein said shaft is composed of two cylindrical bodies and includes a second cylindrical portion.

3. The toilet implement according to claim 2, wherein said sine-wave like cam groove is provided on the outer surface of said cylinder and said projection is provided in the inner surface of said second cylindrical portion of the shaft.

4. The toilet implement according to claim 2, wherein said sine-wave like cam groove is provided in the inner surface of said second cylindrical portion of the shaft and said projection is provided on the outer surface of said cylinder.

5. The toilet implement according to claim 2, wherein said longitudinal groove is provided in the inner surface of said cylinder and said longitudinal strip is provided on the outer surface of said first cylindrical portion of the member.

6. The toilet implement according to claim 2, wherein said longitudinal groove is provided on the outer surface of said first cylindrical portion of the member and said longitudinal strip is provided in the inner surface of said cylinder.

* * * * *